US010636243B1

(12) United States Patent
Davis

(10) Patent No.: US 10,636,243 B1
(45) Date of Patent: Apr. 28, 2020

(54) SLIDE TO WIN SKILL-BASED GAME

(71) Applicant: Epic Tech, LLC, Lavonia, GA (US)

(72) Inventor: Steven Wesley Davis, Suwanee, GA (US)

(73) Assignee: Epic Tech, LLC, Suwanee, GA (US)

( * ) Notice: Subject to any disclaimer, the term of this patent is extended or adjusted under 35 U.S.C. 154(b) by 1 day.

(21) Appl. No.: 16/103,760

(22) Filed: Aug. 14, 2018

Related U.S. Application Data

(60) Provisional application No. 62/545,743, filed on Aug. 15, 2017.

(51) Int. Cl.
*G07F 17/32* (2006.01)

(52) U.S. Cl.
CPC ..... *G07F 17/3213* (2013.01); *G07F 17/3209* (2013.01); *G07F 17/3258* (2013.01); *G07F 17/3267* (2013.01)

(58) Field of Classification Search
None
See application file for complete search history.

(56) References Cited

U.S. PATENT DOCUMENTS

2012/0299835 A1* 11/2012 Yoshida ..... G06F 3/018 345/171
2014/0248935 A1* 9/2014 Williams ..... A63F 3/062 463/19
2015/0038205 A1* 2/2015 Duluk ..... G07F 17/3295 463/9

* cited by examiner

*Primary Examiner* — Paul A D'Agostino
(74) *Attorney, Agent, or Firm* — Baker Donelson; Carl M. Davis II

(57) ABSTRACT

A gaming system which displays a first plurality of symbols at each of a plurality of symbol display positions in a matrix format of columns and rows, a placeholder symbol in at least one symbol display position, and a second plurality of symbols in one or more areas separate from the displayed matrix symbols. The system requires a user to slide a virtual bar to select of one of the second plurality of symbols to replace the placeholder symbol, in order to win the game.

22 Claims, 12 Drawing Sheets

Game is initiated.

Matrix symbols are generated.

Slide the bar to select the correct replacement symbol.

Game is initiated.

Matrix symbols are generated.

Provisional win! Slide the bar to select the symbol having the highest value and win the game.

SLIDE TO WIN SKILL-BASED GAME

The present application claims benefit of U.S. Provisional Patent Application Ser. 62/545,743, filed Aug. 15, 2017, which is incorporated herein by reference in its entirety.

TECHNICAL FIELD

The present invention relates to skill-based redemption games, and more particularly, the embodiments disclosed herein relate to software systems for skill-based redemption games.

BACKGROUND

Skill-based redemption games are typically games that require some level of skill in order to win. A winner of such a skill-based redemption game may be rewarded with points, credits, or other such designation. Accumulated points or credits may be exchanged for non-cash merchandise, such as small toys, novelties, gift cards, or other merchandise or service, depending on the jurisdiction in which the skill-based redemption game is located. In order to win, the player must correctly exercise a skill and there are drawbacks to whether the game appropriately evaluates and responds to the demonstrated skill activity. Accordingly there is a need in the art for an improved skill evaluation and response apparatus for redemption games, and the present invention is directed to such.

SUMMARY OF THE INVENTION

The present invention meets the need in the art by providing gaming system that operatively displays a first plurality of symbols at each of a plurality of symbol display positions in a matrix format of columns and rows, a placeholder symbol in at least one symbol display position, and a second plurality of symbols in one or more areas separate from the displayed matrix symbols. The system requires a user to perform a skill in operatively sliding a virtual bar to select of one of the second plurality of symbols to replace the placeholder symbol in order to win the game.

In another embodiment, the invention is directed to a gaming system which displays a first plurality of symbols in a simulated reel format and a second plurality of symbols in one or more areas separate from the first plurality of symbols, wherein the first and second symbols are different. The system requires a user to slide a virtual bar to select a symbol from the second plurality of symbols having the highest value in order to win the game.

Objects, advantages, and features of the present invention are readily ascertained upon a reading of the following detailed description in conjunction with the drawings illustrating the present invention in alternate embodiments and of the appended claims.

BRIEF DESCRIPTION OF THE DRAWINGS

Reference will now be made to the accompanying figures and diagrams, which are not necessarily drawn to scale, and wherein at least some of the drawings include an explanatory text box.

DETAILED DESCRIPTION

In the following description, numerous specific details are set forth. However, it should be understood that embodiments of the present disclosure may be practiced without these specific details. In other instances, well-known methods, structures, and techniques have not been shown in detail in order not to obscure an understanding of this description. References to "one embodiment," "an embodiment," "example embodiment," "various embodiments," and so forth indicate that the embodiment(s) of the present disclosure so described may include a particular feature, structure, or characteristic, but not every embodiment necessarily includes the particular feature, structure, or characteristic. Furthermore, repeated use of the phrase "in one embodiment" does not necessarily refer to the same embodiment, although it may.

As used herein, unless otherwise specified, the use of the ordinal adjectives "first," "second," "third," etc., to describe a common object merely indicates that different instances of like objects are being referred to and are not intended to imply that the objects so described must be in a given sequence, either temporally, spatially, in ranking, or in any other manner.

Embodiments disclosed herein relate to a providing a skill-based redemption game. The skill-based redemption game may be designed to display one or more simulated reels, in matrix of columns and rows, each of which has a plurality of symbol positions and a plurality of symbols displayed thereon. A spin of the simulated reels may occur when the player chooses to play the skill-based redemption game. To win the skill-based redemption game, the player must correctly input information—in some cases the player may be required to select the correct symbol to create a winning pattern and in other cases the player may be required to choose the symbol having the highest value between two or more symbols having varied values. In some embodiment, the input of information by the player is performed by sliding a virtual bar left, right, up, down, diagonally, or in any other direction. In other embodiments the input of information may be performed via the selection of a symbol through a mouse click, keyboard strokes, touch screen, or the like.

Figure 1A:
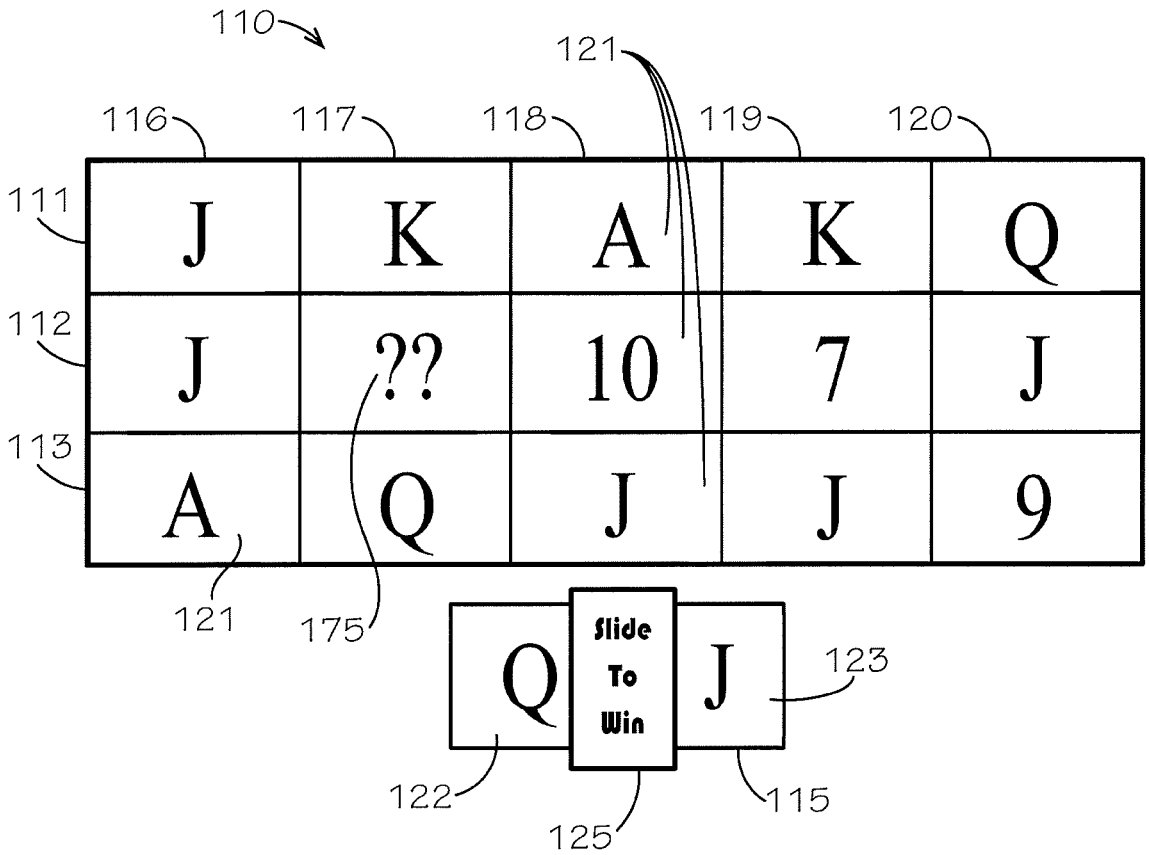
FIGS. 1A, 1B, 1C, 1D and 1E are front views of an illustrative embodiment of the game system disclosed herein illustrating play of a game.

With reference to the drawings in which like parts have like identifiers, generally speaking, as shown in FIG. 1A, the invention is directed to a game based upon one or more simulated sets of rotatable reels, displayed in a matrix format 110 of columns 116, 117, 118, 119, and 120 and rows 111, 112, 113. While it is common to see 5 columns and 3 rows displayed in a matrix, any number of rows or columns may be utilized in the invention. In some embodiments, three, four, or five reels may be displayed. In an embodiment, the number of rows displayed at any given time may be three, four, or five rows. More than five rows or columns may be displayed and any configuration of rows and columns is encompassed herein. In an embodiment, each reel is displayed as a vertical matrix column 116, 117, 118, 119, and 120 and contains one or more symbol positions 121 within each column.

Additionally shown in FIG. 1A is a skill selection area 115. The skill selection area 115 may be displayed anywhere within the display of the game. In the embodiment shown in FIG. 1A, the skill selection area 115 is shown below the matrix, but this positioning is not determinative and the skill selection area 115 may be positioned elsewhere. In fact, the skill selection area 115 may only be visible onscreen as certain times. For example, the skill selection area 115 may be hidden during the reel spin and may appear onscreen (as a pop-up, for example) only after the reels stop spinning. The skill selection area 115 may then disappear again after the user make a selection.

Similarly, the skill selection area 115 is shown as containing two (2) symbols 122, 123. However, any number of symbols may be displayed within the skill selection area 115. For example, in an embodiment illustrated in FIG. 2C, eight (8) symbols 130*a*-130*h* may be displayed in a grid format. In an embodiment, the symbols displayed in the skill selection area 115 are the same as or are a subset of the symbols available for use within the matrix 110 of symbols. In another embodiment, the symbols displayed in the skill selection area 115 are different than the symbols available for use within the matrix 110 of symbols.

In an embodiment, the skill selection area 115 contains a simulated slide bar 125. The slide bar 125 may be displayed in any manner known in the art. In an embodiment, the slide bar 125 may comprise an outline, a highlight, or something of the like. The simulated slide bar 125 may be configured to be moved left, right, up, down, diagonal, or in any other direction. The player may move the simulated slide bar 125 to cover, highlight, outline, or otherwise designate the symbol in the skill selection area 115 the player wishes to select for play in the game. In an embodiment, the user need not actually slide the bar physically, but selects a symbol by clicking on or touching the symbol and the bar slides automatically.

In the embodiment shown, the skill selection area 115 is shown containing two (2) symbols 122, 123 and the slide bar 125 is located between symbols 122 and 123. However, in an embodiment illustrated in FIG. 2C, eight (8) symbols 130*a*-130*h* may be displayed in a grid format and the slide bar 125 may be displayed in the grid space, for example, in a center portion of the sequence of the eight symbols. Any configuration of symbols and a slide bar 125 may be utilized. Similarly, the symbols and slide bar 125 need not necessarily be displayed in a grid format. For example, the symbols may be set forth in a triangular or circular shape, with the slide bar 125 positioned in the middle or central portion for selective operation thereof. Similarly, the invention may comprise multiple slide bars 125. For example, two symbols may be displayed with two slide bars that may be positioned adjacent both of the symbols.

In yet another example, rather than the slide bar 125 highlighting or designating the symbol the player wishes to select, the slide bar 125 may cover the symbol the player does not wish to select. For example, the slide bar 125 may take the form of a door that closes over the symbol that is not selected or a tumbling brick wall that covers the symbol that is not selected, such that the only visible symbol is the symbol the player wishes to select. Any graphics known in the art could be used to select or deselect symbols. In an embodiment, the symbol that has been selected will change color or animate in some manner. In an embodiment, the symbol that has not been selected will change color, become grey, fade out, or disappear.

In an embodiment of a first game, a participant initiates a play of the game (see FIG. 1A). A computerized processor receives a game request from the participant. The processor may then display a set of symbols within the matrix 110. The processor may display a set of symbols in a matrix 110 for example comprising three rows and five columns. The symbols may be shown to rotate vertically within the columns, spinning as reels, and eventually coming to stop (or being stopped by the player such as by a stop button (not illustrated)) to display the final set of symbols. In an embodiment, the final set of symbols within the matrix 110 may comprise a placeholder symbol 175 (displayed as two question marks). The placeholder symbol 175 may take any form known in the art. For example, it could be a game logo, a question mark, a door, particular wording, or the like. In an embodiment, the placeholder symbol 175 may be replaced by a symbol that the player selects from the skill selection area 115. The location of the placeholder symbol 175 within the matrix 110 may be designated by the processor before, during, or after the generation of the matrix symbols, in various embodiments. In an embodiment, the processor may generate and/or display more than one placeholder symbol 175. In an embodiment, not every game has a placeholder symbol displayed and, instead, the display of the placeholder symbol is triggered by an event.

The processor may determine the location of the placeholder symbol 175 within the matrix using any method known in the art. In one embodiment, the location of the placeholder symbol 175 is predetermined and corresponds to the particular predetermined game that is presented to the player. In another embodiment, the location of the placeholder symbol 175 is randomly determined by the processor, using a random number generator (RNG) process or the like. In yet another embodiment, the location of the placeholder symbol 175 is determined by the processor in a "smart" or "intelligent" manner. That is, the processor may analyze the final matrix symbols and determine which symbol position for the placeholder symbol 175 would create the greatest benefit for the player, if correctly replaced. The processor may then generate and/or display a placeholder symbol 175 in that position. In an embodiment, the processor may make the smart selection of the location of the placeholder symbol based solely on the matrix symbols.

Before, after, or simultaneous with the display of the matrix 110 symbols, the processor may also determine, select, and/or display symbols within the skill selection area 115. One or more symbols may be displayed within the skill selection area 115. In an embodiment, the processor may rotate symbols through the skill selection area 115, temporarily displaying each one until the reels stop spinning and the sequencing display of the symbols in the skill selection area 115 also come to stop. In an embodiment, the symbols in the skill selection area 115 come to stop before, after, or near the time that the reels stop. In an embodiment, the timing on selection of the symbols within the skill selection area 115 is related to the timing of the matrix reel spin, but is not the same as the timing of the matrix reel spin. For example, the cycling of the symbols within the skill selection area 115 may occur at a slower or faster rate than the spinning of the matrix reels. Similarly, the cycling of the symbols within the skill selection area 115 may begin and/or end before or after the spinning of the matrix reels. In an embodiment, the cycling of the symbols within the skill selection area 115 may be of the same speed and duration of the matrix reel spin.

The processor may determine the symbols to be displayed within the skill selection area 115 using any method known in the art. The symbols may be generated in a predetermined manner, corresponding to the particular game or may be generated randomly. Similarly, the symbols to be displayed within the skill selection area 115 may be determined in a smart or intelligent manner, based upon which symbols would provide the greatest benefit to the player. In a particular embodiment, the processor may prompt the player to select one or more symbol positions in which to place the symbol(s) displayed within the skill selection area 115.

In an embodiment, the processor may make the smart selection of the location of the placeholder symbol based on a combination of the matrix symbols and the symbols in the skill selection area. For example, if the symbols in the skill selection area are generated prior to the smart selection of the placeholder symbol position, the smart selection may consider only locations for those displayed skill selection symbols. In a particular embodiment, after generation and display of the matrix symbols, the processor may prompt the player to select a symbol position in which to place the placeholder symbol 175.

Figure 1B:
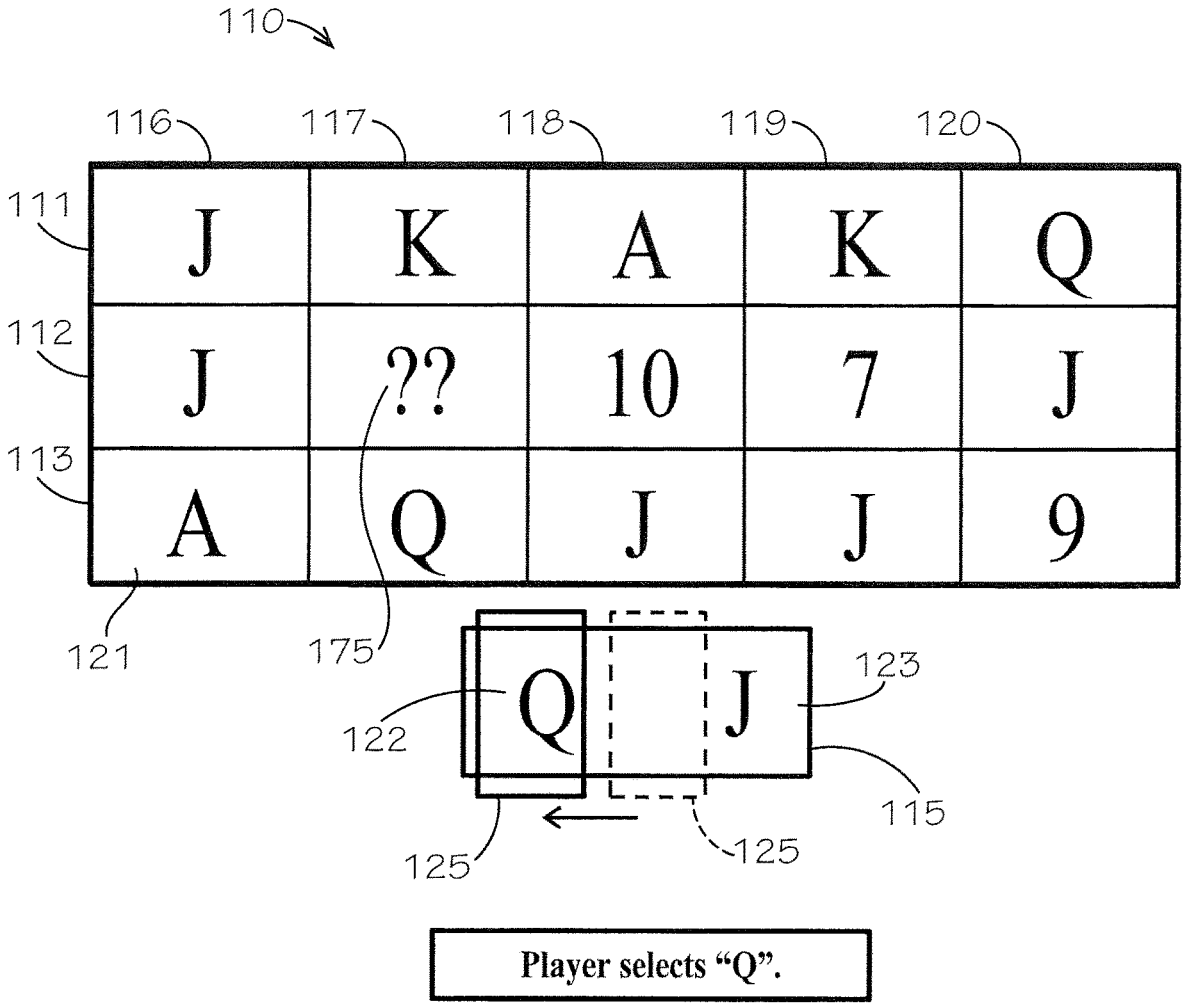
Figure 1C:
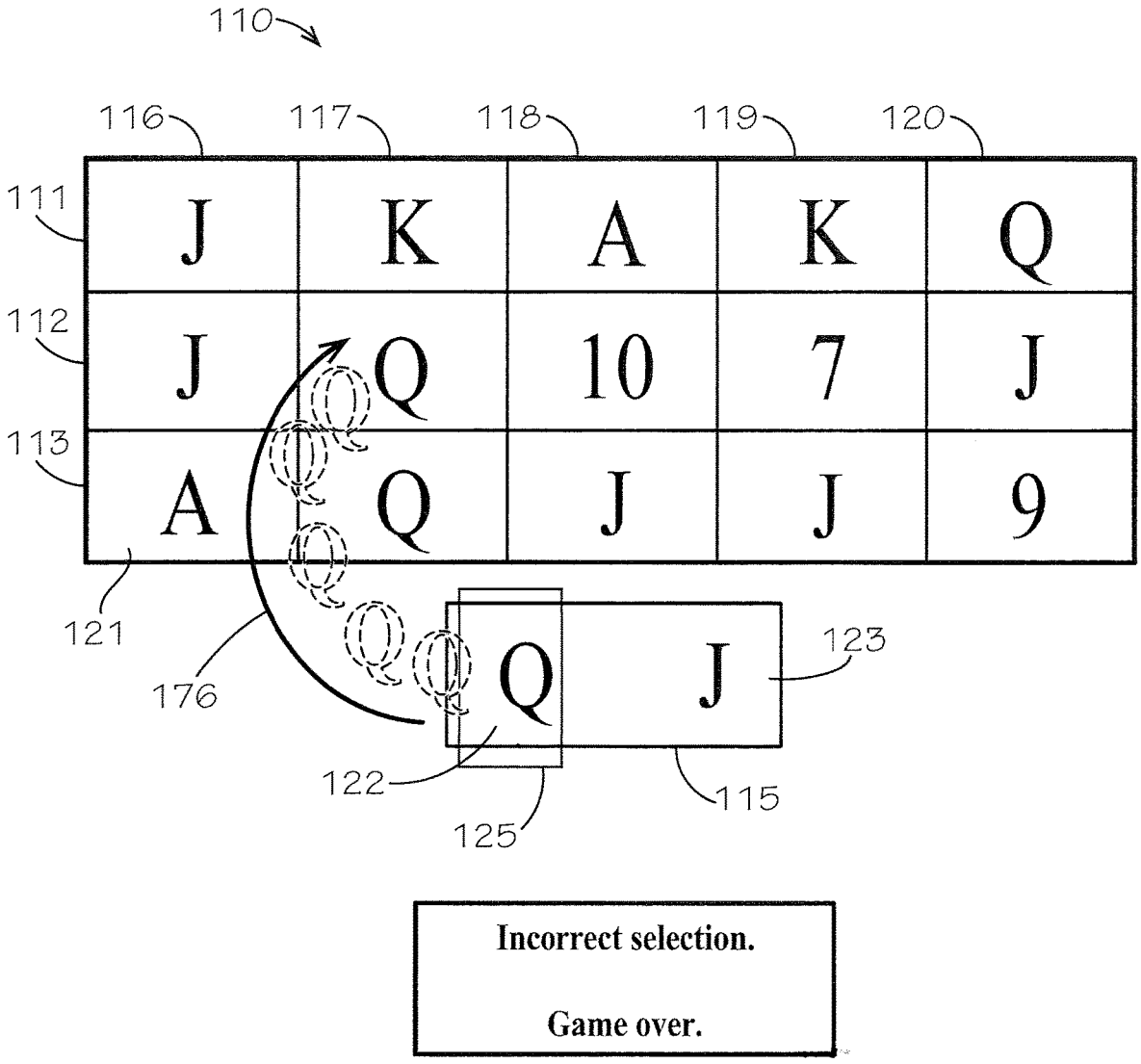

In an embodiment, the processor may then prompt the player to make a symbol selection within the skill selection area 115. In an embodiment, the player is required to choose a symbol which will be substituted into the matrix, to replace the placeholder symbol 175. FIG. 1B illustrates a player moving the slide bar 125 to the left, selecting the "Q" within the skill selection area 115. In an embodiment, the processor may visually display the symbol being replaced into the placeholder symbol 175 position. The symbol may animate generally 176 across the display screen to its position in the placeholder symbol 175 position (shown in FIG. 1C) or may disappear from the skill selection area 115 and reappear within the matrix 110, these alternate presentation mechanisms described here merely as examples. In an embodiment, once the player inputs his or her selection, the processor may evaluate the input to determine whether the selected symbol (or the remaining symbol, in the case of a symbol deselection) creates a winning symbol combination or otherwise creates a win. For example, as shown in FIG. 1C, the selection of the "Q" does not create a winning symbol combination relative to the adjacent reels. The "Q" forms non-winning diagonal sequences of "J-Q-J" and "A-Q-A" and a vertical sequence "K-Q-A". As such, the processor may notify the player of the incorrect selection and may end the game.

Figure 1D:
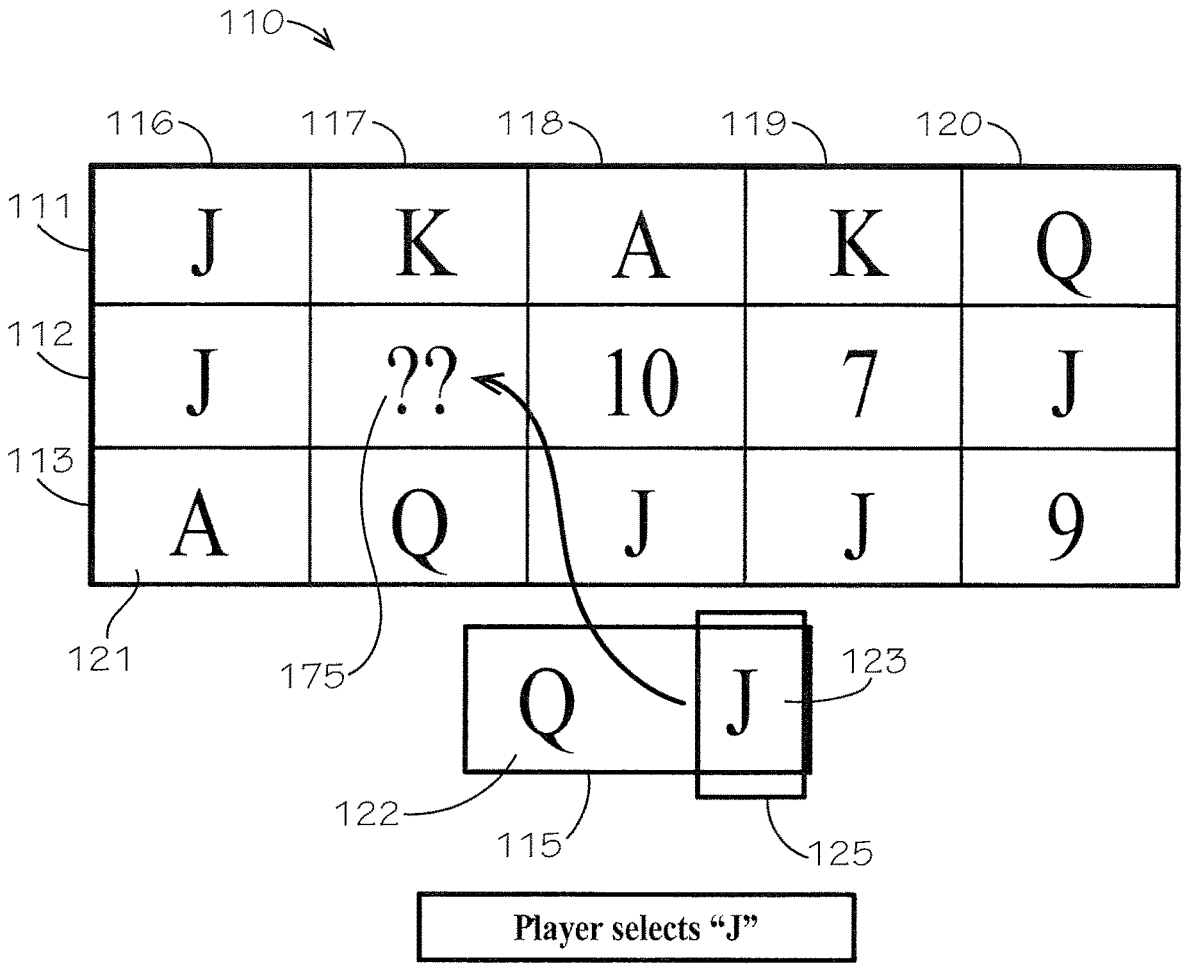
Figure 1E:
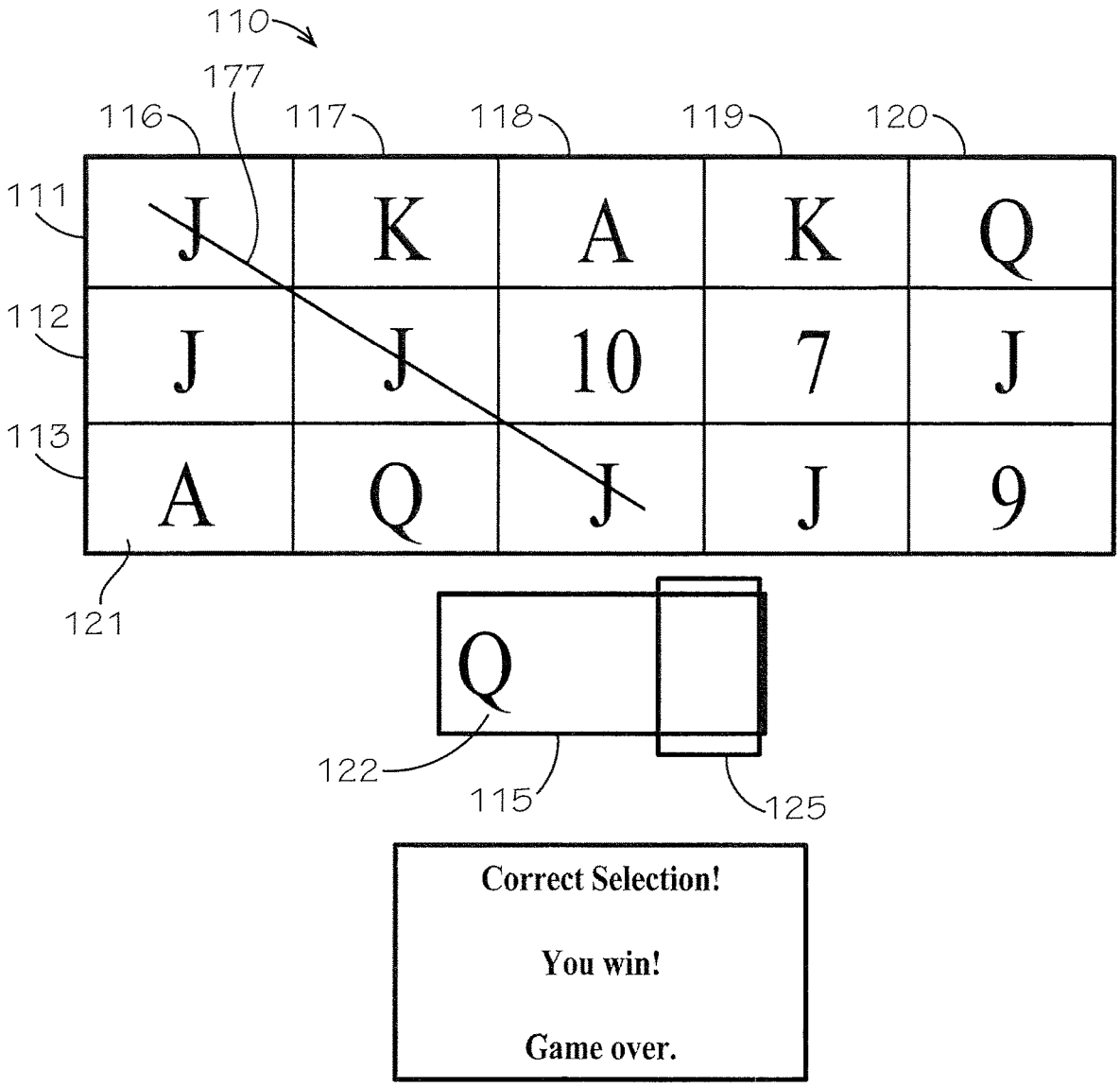

Alternatively, as shown in FIG. 1D, the player upon analysis of the displayed reels and matrix of the symbols, may select the "J" for replacement of the placeholder symbol 175. In this embodiment, the "J" replaces the placeholder symbol 175 (FIG. 1E), creating a diagonal winning pattern of three (3) matching symbols "J-J-J" (denoted in the illustrated embodiment by line 177). The processor may evaluate the matrix to determine whether any winning symbol combinations have been created. The processor may then display and/or award the player with a prize associated with the winning combination 114. In an embodiment, the game is over.

Figure 2A:
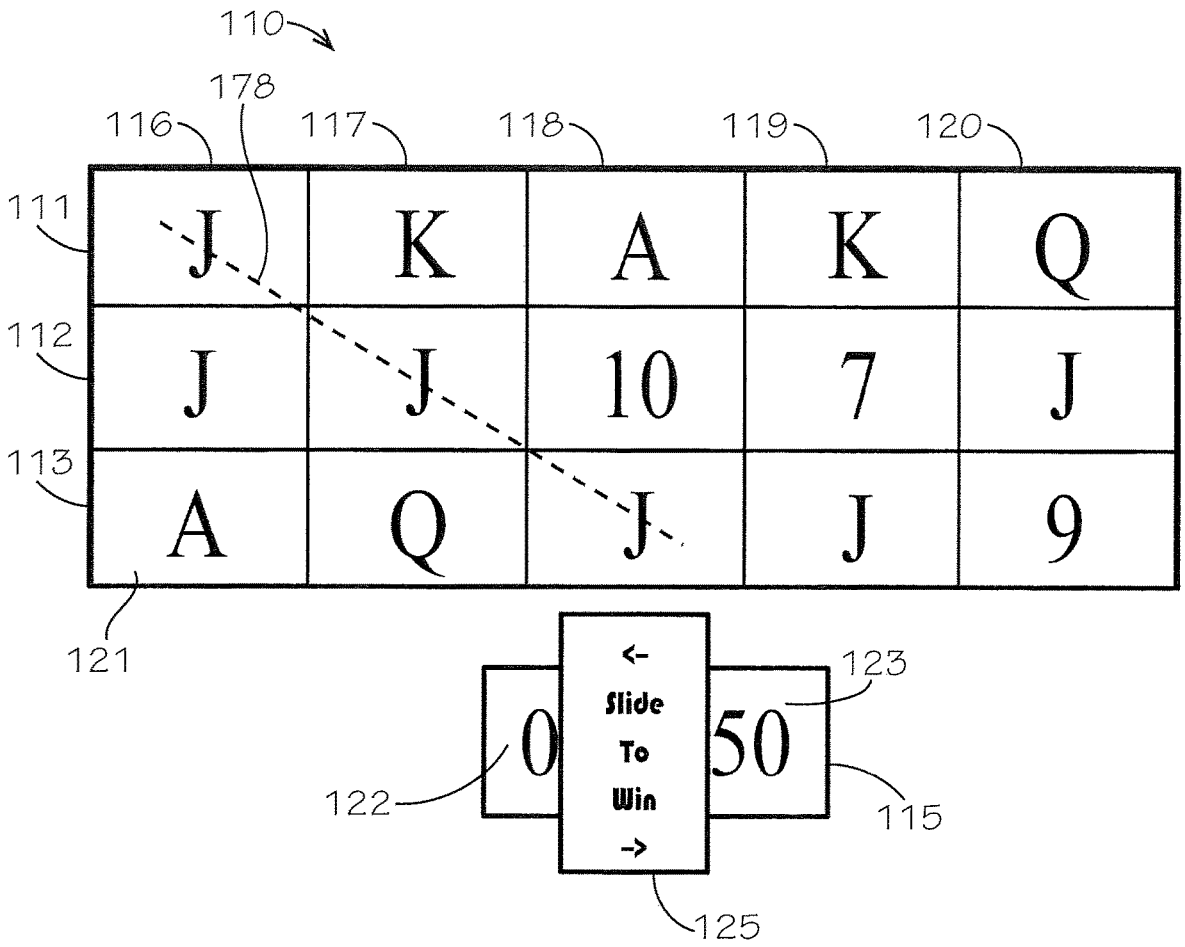
FIG. 2A is a front view of an alternate embodiment of the game system in accordance with the present invention.

In another embodiment of a game illustrated in FIG. 2A, a participant initiates a play of the game. The processor receives a game request from the participant. The processor may then display a set of symbols within the matrix 110. In this embodiment, the matrix 110 may not comprise a placeholder symbol 175. Instead, in some game embodiments, the matrix 110 may display symbols which form a provisional win. Alternatively, in some game embodiments, the matrix 110 may display symbols which do not form a win of any kind and the game may end. As an example of a provisional win, the matrix 110 may display three (3) adjacent matching symbols (shown in FIG. 2A in dashed or broken line generally 178 as a provisional win). However, the win is provisional because the player may be required to exercise the skill feature in order to win the game, thereby activating the provisional win to become an actual win. In this embodiment, the player may be required to select the symbol in the skill selection area 115 having the highest value. The symbols displayed within the skill selection area 115 may be immediately identifiable as one having a higher value than the other (i.e. the number 50 has a higher value than the number 0). In an embodiment, the slide bar symbols change for each game and the symbol of the higher value may appear on the left or on the right of the slide bar. The location of the symbol having the highest value (left, right, up, down, or any other location) may be randomly selected by the system or may be predetermined.

In an alternate embodiment, it may not be readily apparent which symbol displayed within the skill selection area 115 has higher value. For example, the skill selection area 115 may display a chicken on the left and an egg on the right. The player may be required to determine whether the chicken or the egg has a higher value and should, thus, be selected. The player may have to reference a table, chart, or other information indicating the point values or relevant point values of the various symbols.

As set forth above, the symbol in the skill selection area 115 may be selected by sliding the slide bar 125 or by any other method known in the art. If the player makes the correct skill selection, the provisional win becomes or is converted into an actual win, in an embodiment. The processor may then display and/or award the player with a prize associated with the winning combination. In an embodiment, the game is over.

In an embodiment, if any "wild" or "bonus" symbols are generated and displayed in the skill selection area 115, those wild or bonus symbols, if selected, may trigger additional game features. For example, if a wild symbol appears in the skill selection area 115 and is selected, one or more of the matrix symbols may become wild symbols. The wild symbol replaces the placeholder symbol 175 in the matrix and in doing so, takes on the characteristic of the symbol in an adjacent space in order to generate a win. Similarly, if a bonus symbol appears in the skill selection area 115 and is selected, a bonus round may be initiated. The bonus round may be an additional game within the game being played, with this additional game providing an additional opportunity for the player, such as a second one of the game or an additional spin of the reels for possible alignment of a symbol combination that is a win.

In still another embodiment, a game win could trigger the activation of a multiplier within the game. For example in reference to the embodiment illustrated in FIG. 2B, if the player selects the correct symbol within the skill selection area 115, a multiplier 126, for example, a 2x multiplier, could be activated for the next consecutive game. If the player wins the second game, a 3x multiplier could be activated for the next consecutive game. This process could repeat until a certain level of multiplier is reached or until the player participates in a game that he does not win. At that point, the multiplier may restart at zero, may remain locked at the current level, or may be stepped down to a multiplier level which is less than the current level. The multiplier 126 may be visually displayed as shown in FIG. 2B to the player in an area of the game display screen.

Figure 2B:
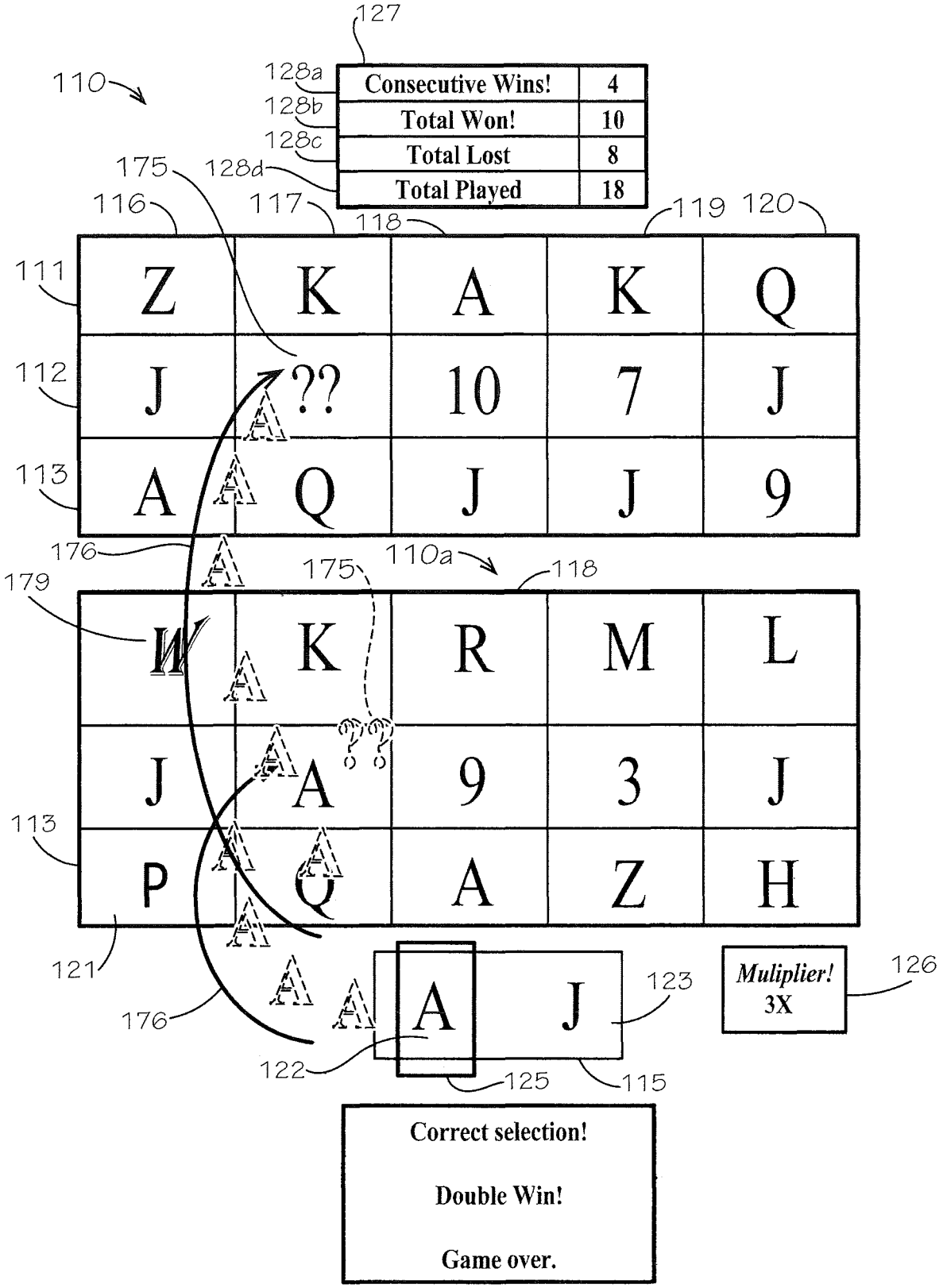
FIG. 2B is a front view of an alternate embodiment illustrating optional features of the game system in accordance with the present invention.
Figure 2C:
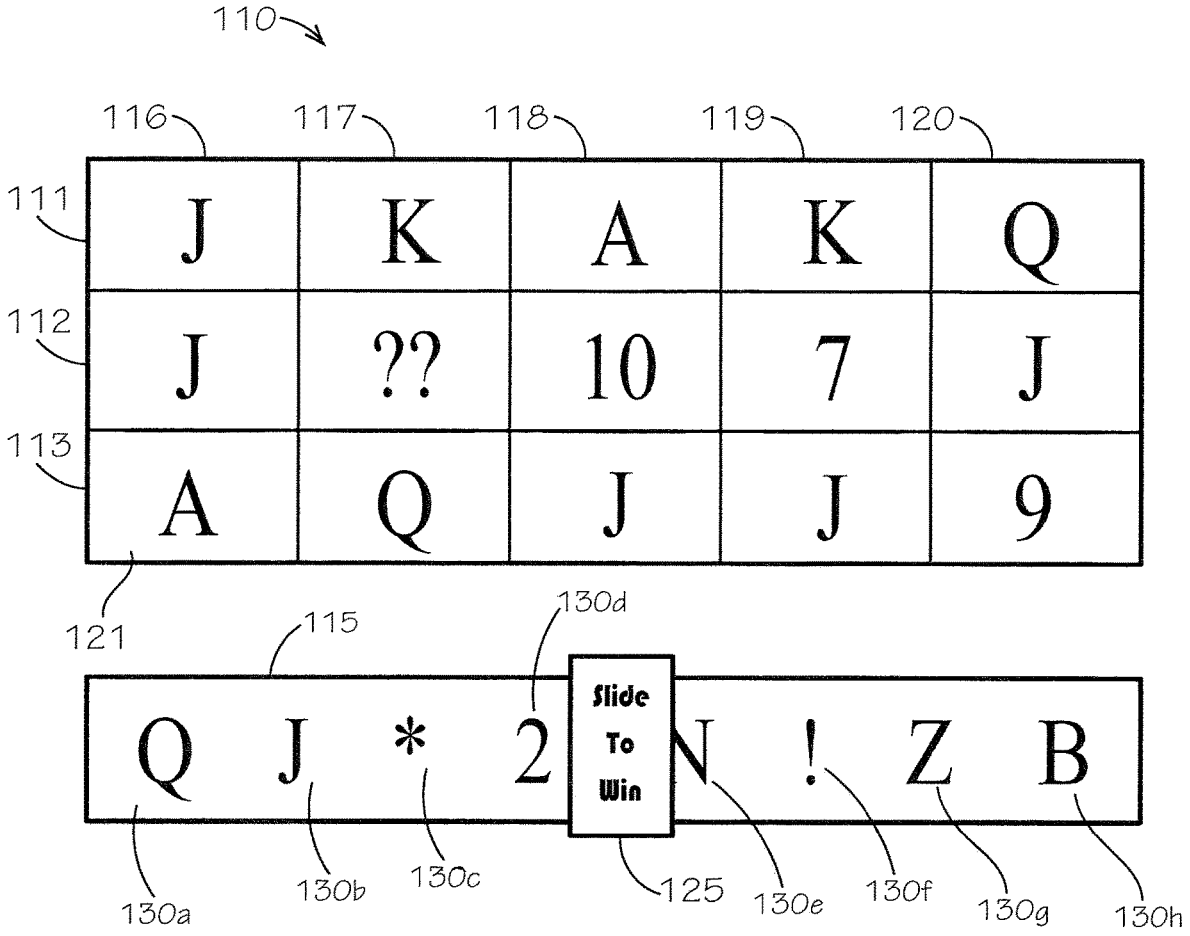
FIG. 2C is a front view of an alternate embodiment of the game system in accordance with the present invention.

In an embodiment as illustrated in FIG. 2B, a visual display of game information 127 is presented, for example, the number of consecutively won games 128*a*, total won games 128*b*, total lost games 128*c*, and/or the total number of games played 128*d*, may be visually displayed onscreen to the player.

In another embodiment also illustrated in FIG. 2B, the processor may trigger duplicating reel sets under certain circumstances. For example, if the player wins a certain number of games (as optionally indicated by an onscreen tally), a second reel set 110*a* may appear onscreen. The second reel set may have the same or different symbols displayed it its matrix. In an embodiment, the second reel set is a duplicate of the first reel set, but once the reels begin to spin, they may generate different symbols in different positions or may start and stop at different times, increasing the possible number of wins. The number of reel sets may progressively increase based upon the number of consecutively won games or any other trigger. For example, in game 1, one reel set may be displayed. If the player wins the game, in game two, two reel sets may be displayed. If the player wins game two, in game three, three reel sets may be displayed. In an embodiment, up to eight (8) or more reel sets may be displayed. With each additional reel set, the number of win possibilities increases. Each reel set may have its own skill selection area 115 or all of the reel sets may be controlled by a single skill selection area 115. That is, one skill selection area 115 may be presented to the player and when a symbol is selected, the symbol may be substituted into or may otherwise apply to all of the displayed reel sets. The reel sets may be displayed above or below each other, side-by-side, in a grid format, circular format, or in any configuration known. Each reel set may spin and display symbols independently of the others, in an embodiment. The number of reel sets displayed may reset to one when the player loses a game.

In an alternate embodiment illustrated in FIG. 2B, a reel may have a wild symbol 179 that takes on the characteristic of the replacement symbol selected by the player from the symbol selection area 115. In this way, the game may generate a winding symbol combination such as the diagonal "A (substituted wild symbol W (179)-A (replacement symbol)-A (in third reel, column 118, row 113). (It is for purposes of ease of illustration that the placeholder symbol 175 is illustrated in the second reel, column 117, row 112, as the placeholder symbol space may occur in any of the symbol spaces of the matrix.)

In still another embodiment, the processor may trigger additional reels or rows added to the matrix 110 under certain circumstances. For example, if the player wins a certain number of games (as optionally indicated by an onscreen tally), an additional reel may appear onscreen for the following game. The number of reels may continue to increase for consecutive wins. For example, in game 1 as shown in FIG. 1A, five reels may be displayed. If the player wins the game, in game two, six reels may be displayed. If the player wins game two, in game three, seven reels may be displayed. With each additional reel displayed, the number of win possibilities increases. Similarly, the number of rows could increase based upon similar triggers. In an embodiment, the number of rows and the number of columns each increase based upon various triggers. The number of rows and columns may reset to their original configuration if the player loses a game, in an embodiment.

Figure 3:
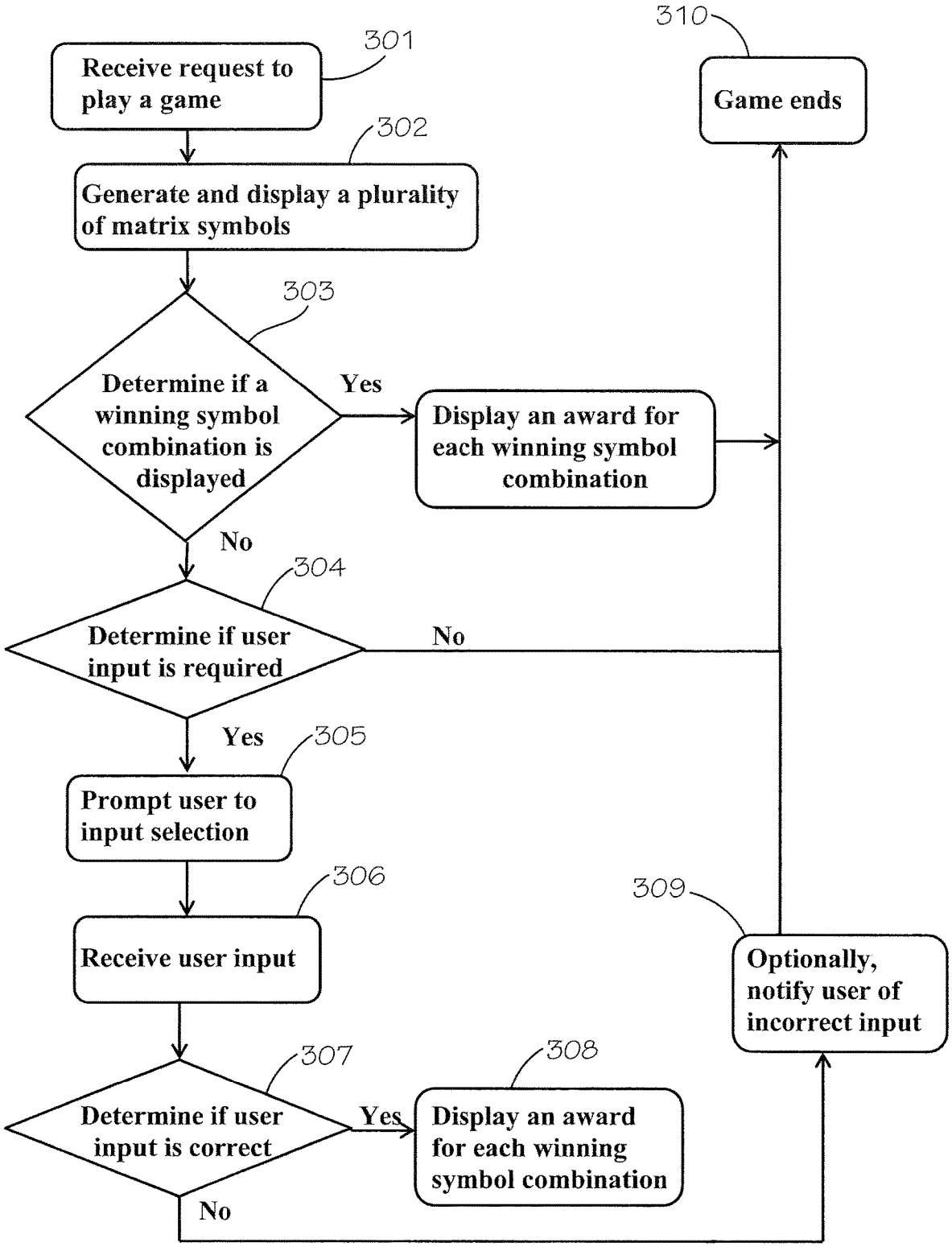
FIG. 3 is a flow chart showing an exemplary process for operating a game system according to the present invention.

Referring now to FIG. 3, a method for implementation of the invention is set forth in a flow chart. In this embodiment, the processor receives a request to play a game at step 301. This would typically involve a player approaching a game device having a microprocessor configured with software instructions that upon execution perform the game presently disclosed, which may be operated by inserting money, a card, a receipt, or the like for initiating play of the game. Similarly, this may involve the player logging into a terminal. Similarly, this may simply involve a participant pressing a "start," "spin," "play," "reveal," or other game initiation button (mechanical or digital). At step 302, the processor generates and displays a plurality of matrix symbols.

The processor, at step 303, then determines if a winning symbol combination is displayed. If yes, the processor displays an award for each winning symbol combination and then the game ends at step 310 and the processor awaits a new request to play a game. If no, the processor, at step 304, determines if the game requires user input. For example, if the displayed matrix symbols do not form a possible or provisional winning combination, no user input may be required. There may be no way for the user to win the game and, as such, no input may be required. If no user input is required, the game then ends at Step 310 and the processor awaits a new request to play a game.

If however, user input is required, the process continues. For example, the user may exercise a skill by which a symbol is selected for input to the game. For example, if the matrix displays a provisional winning symbol combination as discussed above, user input may be required to win the game. If user input is required, the processor prompts the user at Step 305 to input a selection. In the case of a provisional win as shown in FIG. 2A, the user may be required to select the symbol having the higher or highest point value, for example. If the game requires a symbol substitution as shown in FIGS. 1A-1C, the user input may comprise the selection of a symbol to be replaced in the matrix. At Step 306, the processor receives the user input.

At Step 307, the processor determines whether the user input was correct. For example, if the user was required to select a replacement symbol, the processor may determine if the selected symbol was correct, thereby creating a winning symbol combination. Similarly, if a provisional win was displayed in the matrix, the processor may require the user to select a symbol having the higher value (i.e. the "0" or the "50"; the chicken or the egg). In this step, the processor would determine whether the user selected the symbol having the higher value.

If the processor determines that the user input was correct, the processor may display an award for each winning symbol combination (Step 308). If the processor determines that the user input was not correct, the processor may, optionally, notify the user of the incorrect input (Step 309). In either case, the game then ends at Step 310 and the processor awaits a new request to play a game. At or near the completion of the game, the system and device may be configured to allocate prizes to an account associated with the participant or directly pay the participant from the machine.

The game interface may display a variety of information, graphics, animations, etc. For example, the game interface may display a "Win" amount, which may display the amount of money the player has won after a successful game. The game may also display an amount of credits used to play the particular game. Such an amount may be designated, in one embodiment, as "Total Play" or a similar designation. In one embodiment, the game may also display up and down arrows, which may enable a player to adjust the amount of money or credits played for a particular game, as well as a "MAX" button to allow the player to use the maximum amount of credits permitted (by law or as desired by a provider of game) for a particular game. Further, the game may display a "Play" or similar button which initiates the start of a new game.

In one embodiment, the game also displays a help button, a menu button, and a volume adjustment button. The help button may provide the player with instructions on how to play the skill-based game, prizes available, and other relevant information. The menu button may enable the player to adjust certain settings of the game. In one embodiment, the game may display a "stop" or similar button that enables the player to control when the simulated reels stop spinning, either individually or collectively.

The game may also display a jackpot amount. Further, the game also may display a bonus amount and bonus counter. In one embodiment, the bonus amount is increased when a player has an unsuccessful game. Further, the bonus counter may be decremented when a player has a successful game. If the player has a certain number of consecutive successful games (e.g., 10, 15, or any other number), the player may be rewarded with the bonus amount. Additionally, the bonus counter may be reset each time the player has an unsuccessful game.

The winning combination may be determined based upon symbols (matching or otherwise) lining up along a predetermined payline, appearing in predetermined matrix positions, or using any other method known in the art. At the end of each game, wins may be calculated. Any payline known in the art may be utilized to calculate wins. Wins may be calculated left-to-right or right-to-left. Similarly, any scatter pattern (or other known win methodology) known in the art could be used to calculate wins. Wild or bonus symbols may be utilized within and throughout the game to increase excitement and calculate wins.

In some embodiments, a player may receive prizes in addition to, or replacement for, credits won in the game. In one such embodiment, a player may be provided with an opportunity to play a bonus round if he or she wins a particular game. In another such embodiment, a player may be provided with one or more free replays if he or she wins a particular game.

In one embodiment, the player may be rewarded for winning consecutive games, and may also be provided with an opportunity to win back money or credits that were lost as a result of a lost game. For example, bonus amount may be increased by the amount played for each game a player loses. Thus, if a player incorrectly replaces a symbol, and used $0.30 to play that game, the bonus amount may be increased by $0.30. Additionally, each time a player wins a game, the bonus counter may be decremented. If the player wins a second consecutive game, the bonus counter is further decremented. When the bonus counter reaches zero, the player may be rewarded with the bonus amount. If the player loses a game, however, the bonus counter may be reset. In one embodiment, the bonus counter and bonus amount are not changed after any game which cannot be won. That is, if no candidate symbol can be replaced with the replacement symbol to create a winning pattern, the bonus counter is not decremented or reset, and the bonus amount is not increased.

While certain of the embodiments described herein are directed to playing the inventive game as a primary or base game, it should be appreciated that the present disclosure may additionally or alternatively be implemented as a secondary or bonus game. In various embodiments, the system may display a player's credit balance, wager, award, monetary credits, point credits, other non-monetary credits, promotional credits, and/or player tracking points or credits.

System Architecture

Figure 4:
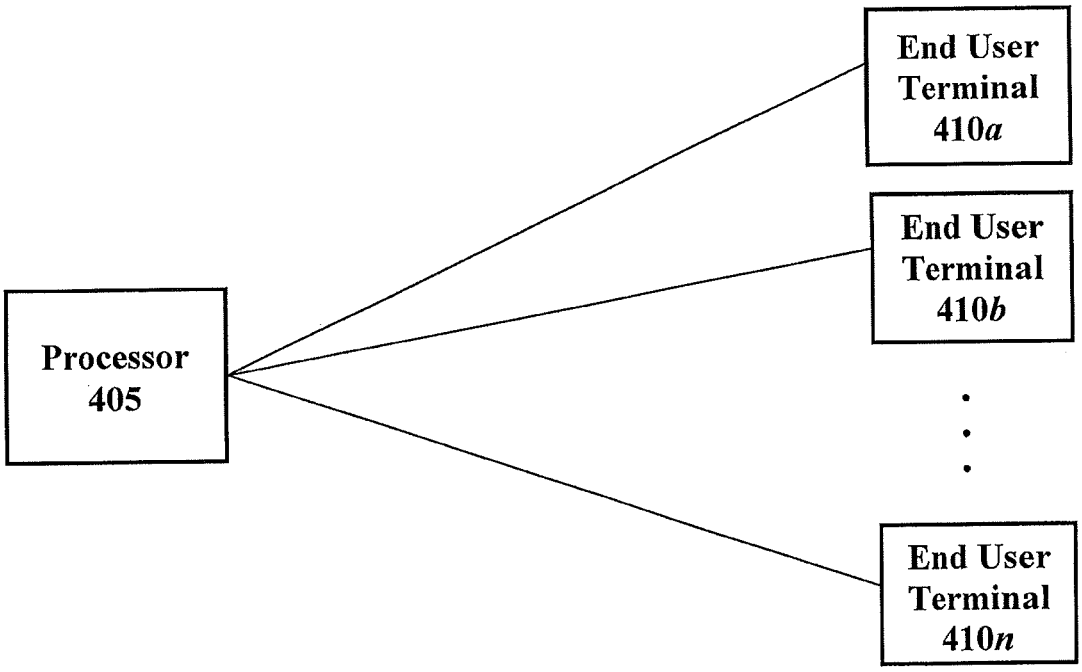
FIGS. 4-7 are block diagrams of the game system in illustrative embodiments according to the present invention.
Figure 5:
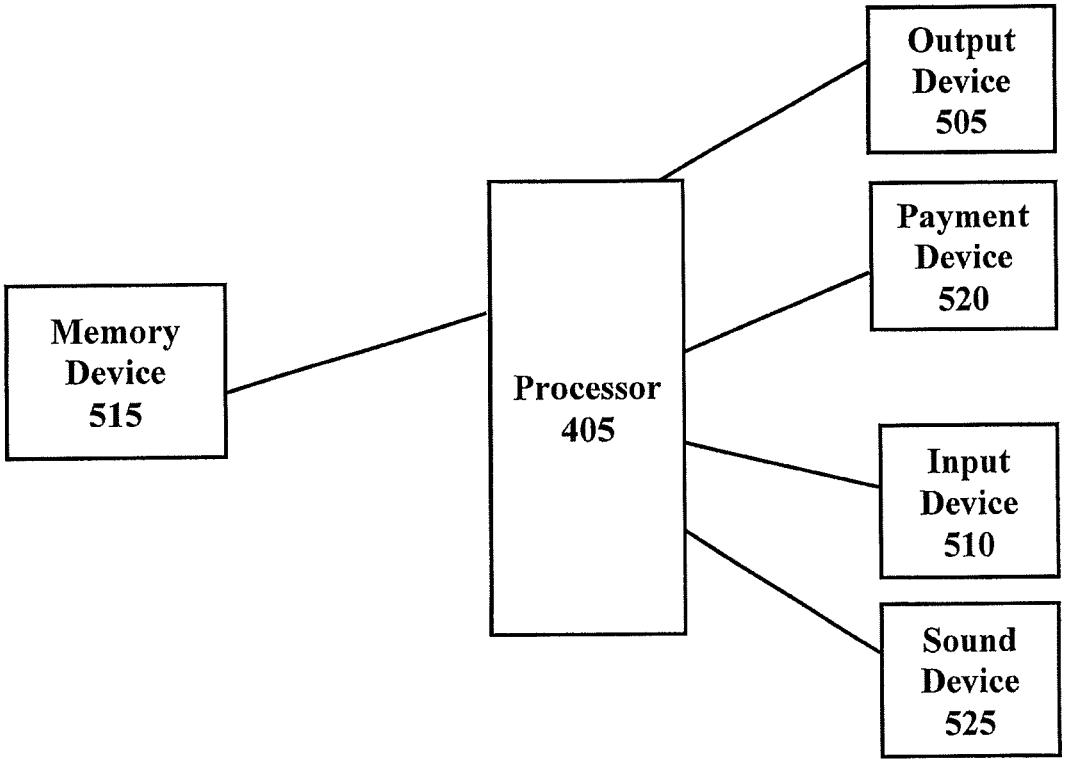

FIG. 4 illustrates an embodiment of a block diagram of the inventive system, illustrating communications between the processor 405 and multiple end user terminals 410. Similarly, FIG. 5 illustrates an embodiment of a block diagram of the inventive system, illustrating communications between the processor 405 and a memory device 515, an output device 505, an input device 510, a payment device 520, and a sound device 525.

Figure 6:
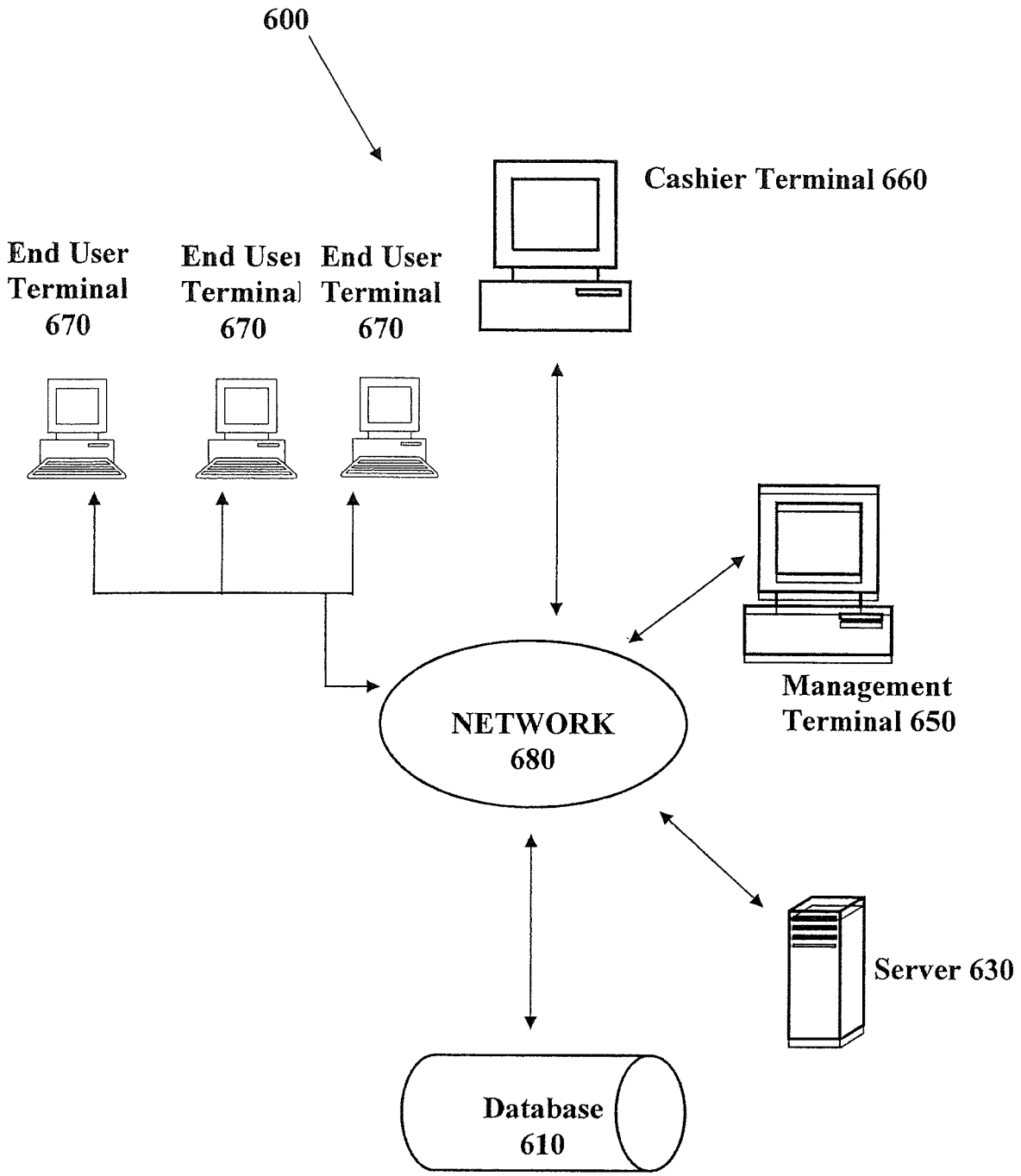

By way of the example shown in FIG. 6, in an embodiment, the inventive system may comprise a network 680, a database 610, at least one server 630, optionally, at least one management terminal 650, optionally, at least one cashier terminal (also known as a point-of-sale terminal or POS terminal) 660, and one or more end user terminals 670, or any combination thereof. Those skilled in the art with reference to this disclosure should appreciate that other configurations may be used to accomplish the methods described herein without departing from the scope of the present invention. For example, in various embodiments, the cashier terminal 660 and the end user terminals 670 may comprise the same device.

It should be understood that each of the computing devices, including the server 630, the management terminal 650, the POS terminal 660, and the one or more end user terminals 670 may each have a computer hardware processor, input and output devices (for example, a computer monitor, a keyboard, selection buttons, and/or mouse) and at least one storage device (for example, memory, hard drives, etc.). These devices may also have network connection cards to connect to the network. At least some of these devices may also include a computer readable medium, which is further described herein.

The server 630 may be configured to communicate data to and from various devices in the system and to perform one or more method steps, as detailed below. The database 610 may contain various types of data and computer instructions for performing at least some of the steps presented herein. It should be understood that the network 680 may be comprised of multiple servers 630 and multiple databases 610, whether located locally and networked through a LAN or remotely through a WAN or an Intranet connection. The end user terminals 670 may be linked together via a network. Each end user terminal 670 may be a standalone game device, a kiosk, a personal computer (PC), a smart phone, a tablet, or other computing device.

The POS terminal 660 and/or the end user terminals 670 may allow a user to purchase game plays. In some embodiments, a user account card may be issued by the POS terminal 660, which contains an electronic account detailing user account information. The user account card may be used at the end user terminals 670 to participate in the games described herein.

A POS terminal 660 (through a cashier or directly) may provide the user with a receipt containing a code (such as a 16-digit hexadecimal code), a PIN, or a username/password that the user may then use for accessing the system or to access his/her account on an end user terminal 670. In an online embodiment, the user may access the inventive system through a browser interface that may provide a similar code to the user after account creation. This code may provide access to the software and/or specifically to the customer's account on the software.

In various embodiments, the system may allow a user to deposit currency into an end user terminal 670 through a credit card reader, currency/bill acceptor, or other device as is known in the art. The management terminal 650 may be a device that is operatively connected with the POS terminal 660, end user terminals 670, and/or server 630 to run cashier reports, calculate revenues and costs, track purchases of games, track prizes awarded, and/or review other game data. Other managerial or supervisory operations may also be performed using the management terminal 650. The server 630 may control one or more operations of the game system, as discussed herein.

One or more of the devices illustrated in FIG. 6 may be connected to network 680 as previously mentioned. In one embodiment, all devices in FIG. 6 are connected to the network 680 and communicate with each other over the network 680. It should be noted that the network 680 in FIG. 1 need not be a single network (such as only the internet) and may be multiple networks (whether connected to each other or not). In another embodiment, the network may be a LAN and a WAN (e.g., the Internet) such that one or more devices (for example, server 630, management terminal 650 and database 610) are connected together via the LAN, and the LAN is connected to the WAN which in turn is connected to other devices (for example, end user terminals 670). The terms "linked together" or "connected together" refers to devices having a common network connection via a network (either directly on a network or indirectly through multiple networks), such as one or more devices on the same LAN, WAN or some network combination thereof.

It should be understood that FIG. 6 is an exemplary embodiment of the present system and various other configurations are within the scope of the present system. For example, one or more of the management terminal 650, point of sale terminal 660, and end user terminals 670 may all be located in one location and server 630 may be located in another location, where all of these system components are operatively coupled by a network such as the Internet. Additionally, it should be understood that additional devices may be included in the system shown in FIG. 6 and some devices shown in FIG. 6 may be omitted from a particular inventive system, such as, by way of example, the point of sale terminal 660. In other embodiments, certain devices may perform the operation of other devices shown in the figure.

Figure 7:
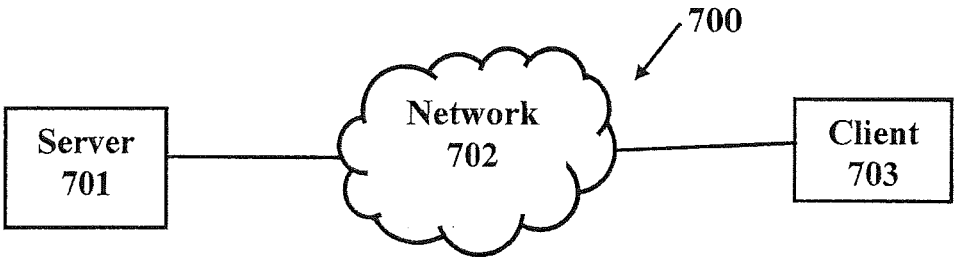

In an embodiment, the inventive system may be available to customers online, via the internet. As shown in FIG. 7, in an embodiment, the system 700 includes a client device 703 that is connected to a server 701 via a network 702. A participant may use the client device 703 to access the game functionality, which is hosted on the server 701. In an embodiment, the game functionality is implemented electronically by software that runs on the server 701. The client device 703 may comprise any type of computing device, as discussed herein.

As used herein, unless otherwise specified, the term "server" may refer to any computing device having a networked connectivity and configured to provide one or more dedicated services to clients. The server may comprise a web server or a cloud server. For purposes of this disclosure, reference to a server or processor, shall be interpreted to include: a single server, a single processor; multiple servers; multiple processors; or any combination of servers and processors. In particular embodiments of the invention, any of the end user terminal 670, the cashier terminal 660, the management terminal 650, and the server 630 may be a computer. The computer may be connected (e.g., networked) to other computers by a LAN, an intranet, an extranet, and/or the Internet. The computer may operate in the capacity of a server or a client computer in a client-server network environment, or as a peer computer in a peer-to-peer (or distributed) network environment. The computer may be a PC, a tablet, a handheld device, a set-top box (STB), a Personal Digital Assistant (PDA), a web appliance, a server, or any computer capable of executing a set of instructions (sequential or otherwise) that specify actions to be taken by that computer. Further, the term "computer" may also include any collection of computers that individually or jointly execute a set (or multiple sets) of instructions to perform any one or more of the methodologies discussed herein.

In some embodiments, the computer architecture may include a processor, a main memory (e.g., read-only memory (ROM), flash memory, dynamic random access memory (DRAM) such as synchronous DRAM (SDRAM) or Rambus DRAM (RDRAM), etc.), a static memory (e.g., flash memory, static random access memory (SRAM), etc.), and a data storage device, which communicate with each other via a bus.

The processor may be a processing device such as a microprocessor, a central processing unit, or the like. More particularly, the processing device may be a complex instruction set computing (CISC) microprocessor, reduced instruction set computing (RISC) microprocessor, very long instruction word (VLIW) microprocessor, a processor implementing other instruction sets, or processors implementing a combination of instruction sets. The processor may also be one or more special-purpose processing devices such as an application specific integrated circuit (ASIC), a field programmable gate array (FPGA), a digital signal processor (DSP), a network processor, or the like. The processor may be configured to execute processing logic for performing various operations and steps discussed herein.

The computer architecture may further include a network interface device. The computer architecture also may include a video display, an input device, and a signal generation device (e.g., a speaker). The video display may include, but is not limited to, a liquid crystal display, a light-emitting diode display, or a cathode-ray tube display. Other such displays are possible as well. The display may be used to show content to a user in the form of text, images, or video. In certain instances, the display may also operate as a touch screen display that may enable the user to initiate commands or operations by touching the screen using certain finger or hand gestures. Input devices may include a keyboard, numeric pad, mouse, trackball, one or more electromechanical buttons, a camera which detects gestures, or another input device.

The data storage device may include a machine accessible storage medium (also known as a non-transitory computer-accessible storage medium, a non-transitory computer-readable storage medium, or a non-transitory computer-readable medium) on which is stored one or more sets of instructions embodying any one or more of the methodologies or functions described herein. The system may also reside, completely or at least partially, within the main memory and/or within processing device during execution thereof by a computer. The main memory and processing device also constitute computer-accessible storage media. Instructions may further be transmitted or received over a network via a network interface device.

While the machine-accessible storage medium may be a single medium, the term "machine-accessible storage medium" should be understood to include a single medium or multiple media (e.g., a centralized or distributed database, and/or associated caches and servers) that store the one or more sets of instructions. The term "machine-accessible storage medium" shall also be understood to include any medium that is capable of storing, encoding, or carrying a set of instructions for execution by the computer and that cause the computer to perform any one or more of the methodologies of the present invention. The term "computer-accessible storage medium" shall accordingly be understood to include, but not be limited to, solid-state memories, optical, and magnetic media. The game system that resides on server 930 may provide various functionalities as discussed herein. In various embodiments, the participant may access the inventive games through end user terminal 970.

In an embodiment, shown in FIG. 5 and as discussed in detail above, the processor 405 may communicate with a payment device 520, one or more input devices 510, one or more output or display devices 505, one or more sound devices 525, and a memory device 515.

The payment device may comprise a note, ticket or bill acceptor, wherein the player inserts paper money, a ticket or voucher. The payment device may comprise a coin slot where the player inserts coins or tokens. In other embodiments, payment devices such as readers or validators for credit cards, debit cards or credit slips may accept payment, including magnetic readers as well as wireless (e.g. radio frequency or near field communication) readers. In one embodiment, a player may insert an identification card into a card reader of the device. In one embodiment, the identification card is a smart card having a programmed microchip or a magnetic strip coded with a player's identification, credit totals (or related data) and other relevant information. In another embodiment, a player may carry a portable device, such as a cell phone, RFID or any other suitable wireless device which communicates a player's identification, credit totals (or related data) and other relevant information to the device. The payment device may also include a card reader to read a customer loyalty or other identification card. The payment device may also include a receipt printer and dispenser to provide a user or player with a receipt. In one embodiment, the payment device may provide the user with a receipt containing a code, such as a 16-digit hexadecimal code, that a user or player can use to access an account on a separate device, computer, or game terminal. In one embodiment, the user may be required to input biographical or identifying information, such as a name, phone number, username, password, date of birth, e-mail address, or other information, when playing a game on game terminal. Such information may also be stored in memory, or communicated to a server.

In one embodiment, one or more game devices are in communication with each other and/or at least one central server, central controller or remote host through a data network or remote communication link. In this embodiment, the central server, central controller or remote host is any suitable server or computing device which includes at least one processor and at least one memory or storage device. In different such embodiments, the central server is a progressive controller or a processor of one of the game devices in the game system. In these embodiments, the processor of each game device is designed to transmit and receive events, messages, commands or any other suitable data or signal between the individual game device and the central server. The game device processor is operable to execute such communicated events, messages or commands in conjunction with the operation of the game device. Moreover, the processor of the central server is designed to transmit and receive events, messages, commands or any other suitable data or signal between the central server and each of the individual game devices. The central server processor is operable to execute such communicated events, messages or commands in conjunction with the operation of the central server. It should be appreciated that one, more or each of the functions of the central controller as disclosed herein may be performed by one or more game device processors. It should be further appreciated that one, more or each of the functions of one or more game device processors as disclosed herein may be performed by the central controller.

In one embodiment, the game outcome provided to the player is determined by a central server or controller and provided to the player at the game device. In this embodiment, each of a plurality of such game devices are in communication with the central server or controller. Upon a player initiating game play at one of the game devices, the initiated game device communicates a game outcome request to the central server or controller.

In one embodiment, the central server or controller receives the game outcome request and randomly generates a game outcome for the game based on probability data. In this embodiment, the central server or controller is capable of storing and utilizing program code or other data similar to the processor and memory device of the game device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

In an embodiment, a game module may store one or more winning combinations of symbols and prize information corresponding to the winning combinations. In one embodiment, the game module may be downloaded from the server, and data associated with the game module may be stored on the server or on a collection of servers. The memory may store the game module, which includes a plurality of computer-executable instructions that may be executed by the computer processor to perform a variety of tasks.

While certain embodiments of the present disclosure have been described in connection with what is presently considered to be the most practical and various embodiments, it is to be understood that the present disclosure is not to be limited to the disclosed embodiments, but is intended to cover various modifications and equivalent arrangements included within the scope of the appended claims. Although specific terms are employed herein, they are used in a generic and descriptive sense only and not for purposes of limitation.

This written description uses examples to disclose certain embodiments of the present disclosure, including the best mode, and also to enable any person skilled in the art to practice certain embodiments of the present disclosure, including making and using any devices or systems and performing any incorporated methods. The patentable scope of certain embodiments of the present disclosure is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A gaming system comprising:

a) at least one input device;

b) at least one display device; and c) at least one processor which is configured to:

i) receive a request, via the input device, from a user to play a first game;

ii) display, on the display device, one of a first plurality of symbols at each of a plurality of symbol display positions in a matrix format of columns and rows;

iii) display, on the display device, a placeholder symbol in at least one symbol display position;

iv) display, on the display device, a second plurality of symbols in one or more areas separate from the displayed matrix symbols;

v) require a user to slide a virtual bar to select of one of the second plurality of symbols to replace the placeholder symbol, in order to win the game;

vi) replace the placeholder symbol with the user-selected second symbol;

vii) determine if the matrix symbols form any winning symbol combinations;

viii) if the matrix symbols form at least one winning symbol combination, display one of a plurality of awards for each displayed winning symbol combination; and ix) repeat the steps for at least one subsequent game.

2. The gaming system of claim 1 wherein the processor randomly determines the symbol display position for the placeholder symbol.

3. The gaming system of claim 1 wherein for each game, the displayed matrix symbols, displayed second plurality of symbols, and placeholder symbol display position are each predetermined.

4. The gaming system of claim 1 wherein the processor analyzes the displayed matrix symbols to determine the optimal symbol display position for the placeholder symbol.

5. The gaming system of claim 1 wherein the processor analyzes the displayed matrix symbols and the displayed second plurality of symbols to determine the optimal symbol display position for the placeholder symbol.

6. The gaming system of claim 1 wherein the user determines the symbol display position for the placeholder symbol.

7. The gaming system of claim 1 wherein the second plurality of symbols comprises two symbols.

8. The gaming system of claim 1 wherein the second plurality of symbols comprises four symbols.

9. The gaming system of claim 1 wherein the second plurality of symbols comprises eight symbols.

10. The gaming system of claim 1 wherein the second plurality of symbols comprises at least one wild symbol.

11. The gaming system of claim 1, wherein the first plurality of symbols comprises at least one wild symbol that takes on a characteristic of an adjacent symbol during game play to generate a winning symbol combination based on the selection of the replacement one of the second plurality of symbols.

12. A computer-implemented method for providing a skill-based game, comprising the steps of:

receiving, by at least one processor, an indication of a user desire to participate in the skill-based game;

decreasing, by the at least one processor, an account balance associated with the user;

simulating, by the at least one processor, a first rotation of at least one displayed simulated reel comprising a first plurality of symbols;

displaying, by the at least one processor, a placeholder symbol in at least one symbol display position;

prior to the next simulated rotation of the displayed at least one simulated reel, generating, by the at least one processor, a second plurality of symbols in one or more areas separate from the displayed at least one simulated reel, wherein the second plurality of symbols are a subset of the first plurality of symbols;

requiring, by the at least one processor, a user to slide a virtual bar to select of one of the second plurality of symbols to replace the placeholder symbol in order to win the game;

replacing, by the at least one processor, the placeholder symbol with the user-selected second symbol;

determining, by the at least one processor and based on the user selection, if the symbols on the simulated reel display a winning combination of symbols;

increasing, by the at least one processor, the account balance associated with the user for a winning combination determined by the processor; and repeating the steps for at least one subsequent game.

13. The method of claim 12 wherein the processor randomly determines the symbol display position for the placeholder symbol.

14. The method of claim 12 wherein for each game, the displayed matrix symbols, displayed second plurality of symbols, and placeholder symbol display position are each predetermined.

15. The method of claim 12 wherein the processor analyzes the displayed matrix symbols to determine the optimal symbol display position for the placeholder symbol.

16. The method of claim 12 wherein the processor analyzes the displayed matrix symbols and the displayed second plurality of symbols to determine the optimal symbol display position for the placeholder symbol.

17. A computer-implemented method for providing a skill-based game, comprising the steps of:

receiving, by at least one processor, an indication of a user desire to participate in the skill-based game;

decreasing, by the at least one processor, an account balance associated with the user;

simulating, by the at least one processor, a first rotation of at least one displayed simulated reel comprising a first plurality of symbols;

determining, by the at least one processor, if a provisional win is displayed within the simulated reels;

prior to the next simulated rotation of the displayed at least one simulated reel, generating, by the at least one processor, a second plurality of symbols in one or more areas separate from the displayed at least one simulated reel, wherein the second plurality of symbols are each different than the first plurality of symbols;

requiring, by the at least one processor, a user to slide a virtual bar to select the symbol from the second plurality of symbols which has the highest value, in order to win the game;

determining, by the at least one processor and based on the user selection, if the user made the correct selection;

if so, converting the provisional win to an actual win and increasing, by the at least one processor, the account balance associated with the user; and repeating the steps for at least one subsequent game.

18. The method of claim 17 wherein the provisional win is visually displayed to the user.

19. The method of claim 15 wherein the second plurality of symbols are unrelated to the first plurality of symbols.

20. The method of claim 15 wherein the second plurality of symbols are numbers.

21. The method of claim 17 wherein for each game, the displayed first plurality of symbols and the displayed second plurality of symbols are each predetermined.

22. The method of claim 17 wherein for each game, the displayed first plurality of symbols and the displayed second plurality of symbols are each randomly determined.

* * * * *